US008431293B2

(12) United States Patent
Nakamura et al.

(10) Patent No.: US 8,431,293 B2
(45) **Date of Patent: *Apr. 30, 2013**

(54) METHOD OF RECYCLING IMAGE FORMING MATERIAL

(75) Inventors: Mitsutoshi Nakamura, Tokyo (JP); Shigenori Kouno, Tokyo (JP); Masaharu Matsubara, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 408 days.

This patent is subject to a terminal disclaimer.

(21) Appl. No.: 12/767,529

(22) Filed: Apr. 26, 2010

(65) Prior Publication Data

US 2010/0279220 A1 Nov. 4, 2010

(30) Foreign Application Priority Data

Apr. 30, 2009 (JP) ..... 2009-110907

(51) Int. Cl.
*G03G 13/06* (2006.01)

(52) U.S. Cl.
USPC ..... 430/97; 430/124.1; 430/124.13; 430/124.15

(58) Field of Classification Search ..... 430/97, 430/124.1, 124.13, 124.15
See application file for complete search history.

(56) References Cited

U.S. PATENT DOCUMENTS

2010/0248130 A1* 9/2010 Nakamura et al. ..... 430/120.1

FOREIGN PATENT DOCUMENTS

| | | | |
|---|---|---|---|
| JP | 6242627 | | 9/1994 |
| JP | 10142834 | | 5/1998 |
| JP | 2000250249 A | * | 9/2000 |
| JP | 2003005435 | | 1/2003 |
| JP | 4085505 | | 2/2008 |

OTHER PUBLICATIONS

English Translations of JP 2000250249A, JP 2003005435A and JP 10142834.*

* cited by examiner

*Primary Examiner* — Stewart Fraser
(74) *Attorney, Agent, or Firm* — Lucas & Mercanti, LLP

(57) ABSTRACT

A method of recycling an image forming material comprising the steps of holding a toner image formed by employing toner particles in a toner holding layer formed on an image supporting substrate to form a first generation image print, separating the toner particles from the first generation image print; and recycling the separated toner particles to form a second generation image print by holding a toner image formed by employing the separated toner particles in a toner holding layer formed on an image supporting substrate, provided that the image forming material comprises at least toner particles, wherein Condition (1) $0.9 \geqq B/A \geqq 0.1$ and Condition (2) $1 \geqq C/A \geqq 0.9$ are satisfied, A, B and C representing particle shape factors of original toner particles, toner particles held in the image holding layer of the first generation image print; and separated toner particles, respectively.

5 Claims, 4 Drawing Sheets

METHOD OF RECYCLING IMAGE FORMING MATERIAL

This application is based on Japanese Patent Application No. 2009-110907 filed on Apr. 30, 2009 in Japanese Patent Office, the entire content of which is hereby incorporated by reference.

FIELD OF THE INVENTION

The present invention relates to a method of recycling an image forming material, in which toner particles and an image supporting substrate can be separated from an image print, and the toner particles and the image supporting substrate each can be recycled as an image forming material.

BACKGROUND OF THE INVENTION

In view of preventing global warming, energy saving has been considered recently in varieties of fields. Also, in the field of the image forming method via electrophotography, a method to save energy in the fixing process by fixing an image only by pressing without heating (for example, refer to Patent Document 1) or a method to recycle the image supporting substrate (for example, refer to Patent Document 2) has been proposed.

However, in these methods, since toner particles are deformed irreversibly, there is a problem that recycling of the toner particles is difficult.

In order to solve such a problem, proposed is a method in which a concave portion is formed on the surface of an image supporting substrate, and toner particles are electrostatically adhered to fix the image (for example, refer to Patent Document 3) or a method to use toner particles containing a resin having a shape memory (for example, refer to Patent Document 4).

However, when the method to form the concave portion on the surface of an image supporting substrate is applied, desorption of the toner particles from the concave portion tends to occur to cause a stain on the image, or, even when toner particles containing a resin having a shape memory, it is difficult to obtain a high quality image due to the effect of light scattering occurring on the surfaces of toner particles.

Thus, while energy saving has been conventionally attained by the recycling of the image forming materials, there have been only few methods which enable forming a high quality image.

Patent Document 1 Japanese Patent Application Publication Open to Public Inspection (hereafter referred to as JP-A) No. 6-242627

Patent Document 2 JP-A No. 2003-5435

Patent Document 3 Japanese Patent No. 4085505

Patent Document 4 JP-A No. 10-142834

SUMMARY OF THE INVENTION

An object is of the present invention is to provide a method of recycling an image forming material, by which a high quality image print can be obtained, and, simultaneously, energy saving is attained.

One of the aspects to attain the above object of the present invention is a method of recycling an image forming material comprising the steps of:

holding a toner image formed by employing toner particles in a toner holding layer formed on an image supporting substrate to form a first generation image print, separating the toner particles from the first generation image print; and recycling the separated toner particles to form a second generation image print by holding a toner image formed by employing the separated toner particles in a toner holding layer formed on an image supporting substrate, provided that the image forming material comprises at least toner particles, wherein following Conditions (1) and (2) are satisfied, provided that A represents a particle shape factor of the toner particles used for the first generation image print, B represents a particle shape factor of the toner particles after the toner image is held in the toner holding layer of the first generation image print, and C represents a particle shape factor of the toner particles separated from the first generation image print via a separation process, wherein each of the particle shape factors A, B and C is an average value of particle shape factors of 100 toner particles each determined according to a formula of (a minimum diameter of a projection of a particle/a maximum diameter of the projection of the particle):

$$0.9 \geqq B/A \geqq 0.1 \qquad \text{Condition (1)}$$

$$1 \geqq C/A \geqq 0.9. \qquad \text{Condition (2)}$$

DESCRIPTION OF THE PREFERRED EMBODIMENTS

Figure 1A:
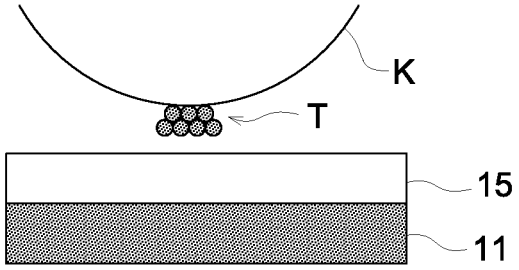
FIG. 1*a* is a schematic illustration explaining an example of an image forming method relating to the present invention illustrating a state in which a toner image is formed on a photoreceptor.

The method of recycling an image forming material of the present invention is characterized in that, a first generation image print is formed via a toner image holding process in which a toner image formed by toner particles is held in a toner holding layer provided on an image supporting substrate;

the toner particles are separated from the first generation image print, and a second generation image print is formed via a toner image holding process in which a toner image formed by the above separated toner particles is held in a toner holding layer provided on an image supporting substrate, wherein following Conditions (1) and (2) are satisfied, provided that A represents a particle shape factor of the toner particles used for the first generation image print, B represents a particle shape factor after the toner image is held in the toner holding layer of the first generation image print, and C represents a particle shape factor of the toner particles separated from the first generation image print via a separation process, wherein each of the particle shape factors A, B and C is an average value of particle shape factors of 100 toner particles each determined by a formula of (a minimum diameter of a projection of a particle/a maximum diameter of the projection of the particle):

$$0.9 \geqq B/A \geqq 0.1 \qquad \text{Condition (1)}$$

$$1 \geqq C/A \geqq 0.9. \qquad \text{Condition (2)}$$

The image forming material includes at least toner particles and preferably includes toner particles and an image forming substrate, however, the image forming material is not limited thereto.

In the method of recycling an image forming material of the present invention, toner particles preferably contain a material exhibiting elasticity or a shape memory effect.

In the method of recycling an image forming material of the present invention, it is preferable to form an image print employing an image forming material separated from the first generation image print, and it is specifically preferable to form a second generation image print employing an image supporting substrate separated from the first generation image print image print.

In the method of recycling an image forming material of the present invention, it is preferable that the separation process is carried out by immersing the first generation image print in a separation liquid which can dissolve or swell a material constituting the toner holding layer, but does not dissolve the toner particles and the image supporting substrate.

In the method of recycling an image forming material of the present invention, it is preferable that the separation process is carried out by separating the image supporting substrate and the toner holding layer holding the toner image from the first generation image print, followed by immersing the toner holding layer in a separation liquid which can dissolve or swell a material constituting the toner holding layer, but not dissolving the toner particles.

According to the method of recycling an image forming material of the present invention, basically, energy saving can be attained because a toner image is fixed on an image supporting substrate without heat;

the surface of the image print exhibits a highly homogeneous state because obtained image print has a toner holding layer and the toner image is held in the toner holding layer; whereby the light scattering is suppressed, an image print exhibiting a high quality image can be obtained because an toner image having high adhesiveness among the toner particles can be obtained, whereby the toner image becomes smooth; and a large energy saving effect as a whole can be obtained because toner particles and an image supporting substrate can be separated from the image print as image forming materials which are recyclable.

The method of recycling an image forming material of the present invention will now be described in more details.

The method of recycling an image forming material of the present invention is characterized in that, a first generation image print is formed via a toner image holding process in which a toner image formed by toner particles is held in a toner holding layer provided on an image supporting substrate; the toner particles are separated from the first generation image print, and a second generation image print is formed via a similar image forming method employing the separated toner particles. Hereafter, the image forming method in which an image print is obtained via a toner image holding process in which a toner image formed by employing toner particles is held in a toner holding layer formed on an image supporting substrate is also referred to as a "specified image forming method".

<A First Image Forming Method>

Figure 1B:
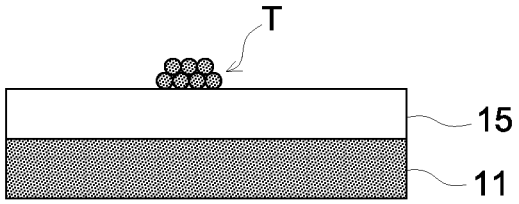
FIG. 1*b* is a schematic illustration explaining the example of the image forming method relating to the present invention illustrating a state in which the toner image is carried on a toner holding layer.
Figure 1C:
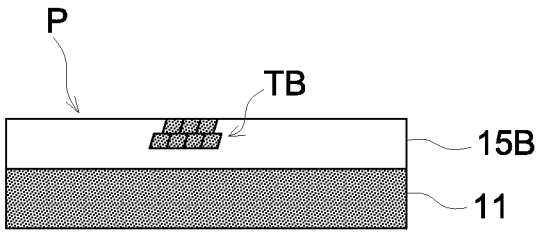
FIG. 1*c* is a schematic illustration explaining the example of the image forming method relating to the present invention illustrating a state in which the toner image is held in the toner holding layer.
Figure 2A:
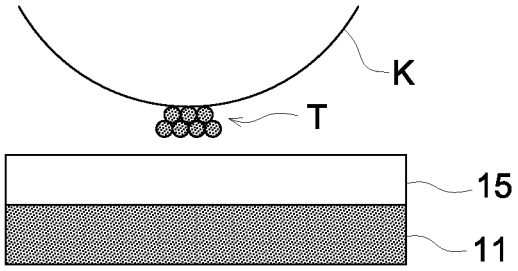
FIG. 2*a* is a schematic illustration explaining another example of an image forming method relating to the present invention illustrating a state in which a toner image is formed on a photoreceptor.
Figure 2B:
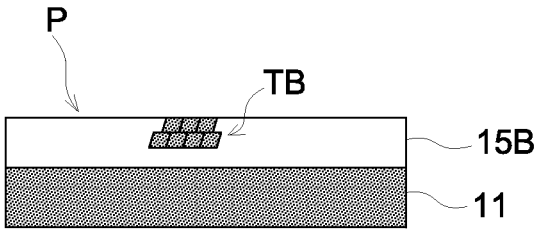
FIG. 2*b* is a schematic illustration explaining the example of the image forming method relating to the present invention illustrating a state in which the toner image is held in the toner holding layer.

In a toner image holding process of the specified image forming method, specifically, after a toner image T elecrostatically formed on a photoreceptor K is carried on a toner holding layer 15 provided on an image supporting substrate 11, as shown in FIGS. 1*a* to 1*c*, or, after conducting a process to bury the toner image T in the toner holding layer 15 with a specified external force for deformation to deform the toner particles and the toner holding layer 15, simultaneously with carrying the toner image T on the toner holding layer 15, as shown in FIGS. 2*a* and 2*b*, a fixing process is conducted, by which the deformation of the toner image TB and the toner holding layer 15B due to a specified external force for fixing is maintained. According to the toner image holding process, the fixing of the toner image 113 is conducted. Thus, an image print P is obtained.

Figure 3A:
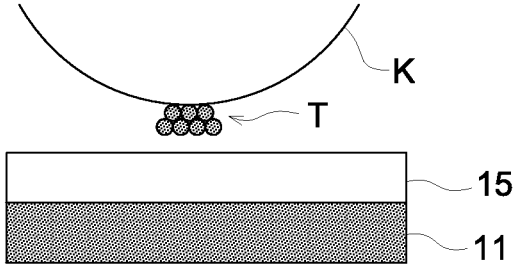
FIG. 3*a* is a schematic illustration explaining another example of an image forming method relating to the present invention illustrating a state in which a toner image is formed on a photoreceptor.
Figure 3B:
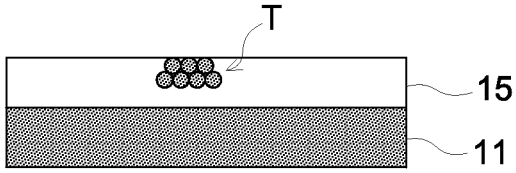
FIG. 3*b* is a schematic illustration explaining the example of the image forming method relating to the present invention illustrating a state in which toner particles are held in a toner holding layer while being accompanied with almost no deformation of the toner particles.
Figure 3C:
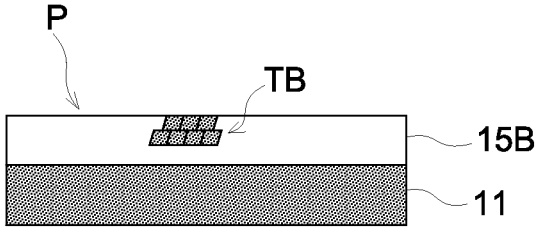
FIG. 3*c* is a schematic illustration explaining the example of the image forming method relating to the present invention illustrating a state in which the toner image is held in the toner holding layer.

Or, the toner image holding process may be conducted, as shown in FIGS. 3*a* to 3*c*, by burying a toner image T elecrostatically formed on a photoreceptor K in a toner holding layer 15 provided on an image supporting substrate 11 by an external force, but without accompanying deformation of the toner particles, and, subsequently, by conducting deformation of the toner particles and the toner holding layer 15 with applying a specified external force for deformation, followed by conducting a fixing process in which the deformation of the toner image TB and the toner holding layer 15B due to the specified external force for fixing is maintained. The external force given to bury the toner particles of the toner image T may be in the range of $1.00\times10^3$-$1.00\times10^8$ Pa.

Examples of a specified external force to deform the toner particles of the toner image T and the toner holding layer 15 include pressuring and heating, and specifically, include heat of 35-100° C. and a pressure of $1.00\times10^3$-$1.00\times10^8$ Pa, depending on the kind of the materials constituting the toner particles and the toner holding layer 15. These external forces may be used in combination. Also, examples of a specified external force to fix the deformed toner image T and the toner holding layer 15 include quenching and light irradiation, and, specifically, include quenching at −253 to 25° C. and irradiation of light having a wavelength of 10 to 400 nm depending on the kind of the materials constituting the toner particles and the toner holding layer 15. These external forces may be used in combination. When the specified external force is heat, the specified external force for fixing is preferably quenching.

Figure 4:
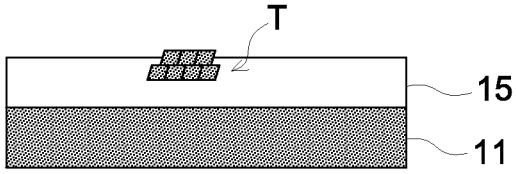
FIG. 4 is a schematic illustration showing an example of one morphology of the image print obtained by the image forming method relating to the present invention.

With respect to the toner image TB fixed in the toner holding layer 15, each of the toner particles forming the toner image TB is preferably buried more than 50% by volume as shown in FIG. 4, and, specifically, all of the toner particles are preferably buried 100% by volume as shown in FIG. 1*c*.

In the specified image forming method of the present invention, the deformation of the toner particles constituting the toner image TB held in the toner holding layer 15 of the obtained image print P satisfies following Condition (1), provided that A represents the particle shape factor of the toner particles used in the toner image holding process, B represents the particle shape factor of the toner particles after subjected to the toner image holding process:

$$0.9 \geqq B/A \geqq 0.1 \qquad \text{Condition (1)}$$

wherein the particle shape factor of the toner particles is represented by:

the minimum particle diameter of the projection of a particle/the maximum particle diameter of the projection of the particle.

The deformation of the toner particles constituting the toner image TB held in the toner holding layer 15 of the obtained image print P satisfying above Condition (1) can be achieved by constituting the toner particles with a material exhibiting elasticity or a shape memory effect, as described in detail below.

When the value of (B/A) representing the extent of the change in the particle shape factor of the toner particles before and after the toner image holding process is within the range of above Condition (1), since the adhesion among the toner particles is high, excellent smoothness of the toner image TB can be obtained, whereby an image print P having a high quality image can be obtained. When, the value of (B/A) representing the extent of the change in the particle shape factor is less than 0.1, a large amount of energy is needed to obtain an image print, which is not preferable in view of a large environmental Specifically, the particle shape factor A of the toner particles used in the toner image holding process is determined by:

removing a toner image T electrostatically formed on a photoreceptor K (refer to FIG. 1*a*);

obtaining an image of the toner particles at a magnification of 2000 times using a scanning electron microscope (SEM) JSM-7401F (produced by JEOL Ltd.);

loading the image of the toner particles in a LUZEX IMAGE PROCESSOR (produced by NIRECO Corp.); and measuring the maximum particle diameter and the minimum particle diameter of each particle to calculate the particle shape factor by dividing the minimum particle diameter with the maximum particle diameter, followed by averaging the particle shape factors of 100 toner particles to obtain the particle shape factor.

The particle shape factor A of the toner particles used in the toner image holding process is preferably 0.40-1.00 and more preferably 0.60-1.00.

The particle shape factor B of the toner particles after subjected to the toner image holding process is, specifically, determined by:

obtaining an image of the toner particles in a cross-sectional slice of an image print P at a magnification of 2000 times using a transmission electron microscope (TEM) JEM-1400F (produced by JEOL Ltd.);

loading the image of the toner particles in a LUZEX IMAGE PROCESSOR (produced by NIRECO Corp.); and measuring the maximum particle diameter and the minimum particle diameter of each particle to calculate the particle shape factor by dividing the minimum particle diameter with the maximum particle diameter, followed by averaging the particle shape factors of 100 toner particles to obtain the particle shape factor.

Figure 1D:
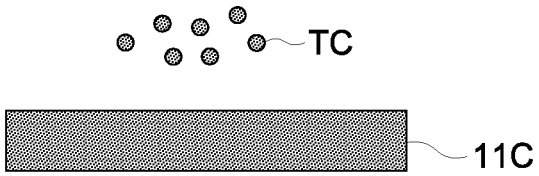
FIG. 1*d* is a schematic illustration explaining the example of the image forming method relating to the present invention illustrating an image supporting substrate and a toner, after being subjected to a separation process.
Figure 2C:
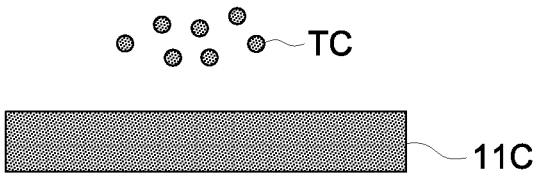
FIG. 2*c* is a schematic illustration explaining the example of the image forming method relating to the present invention illustrating an image supporting substrate and a toner, after being subjected to a separation process.
Figure 3D:
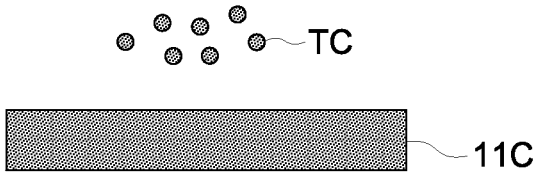
FIG. 3*d* is a schematic illustration explaining the example of the image forming method relating to the present invention illustrating an image supporting substrate and a toner, after being subjected to a separation process.

In the specified image forming method in the method of recycling an image forming material of the present invention, toner particles are separated from the obtained image print P via a separation process, as shown in FIGS. 1*d*, 2*c* and 3*d*, and following Condition (2) is satisfied, provided that A represents a particle shape factor of the toner particles used in the toner image holding process, and C represents a particle shape factor of the toner particles separated via the separation process:

$$1 \geqq C/A \geqq 0.9. \qquad \text{Condition (2)}$$

When the value of (C/A) representing the extent of the change in the particle shape factor of the toner particles before and after the separation process is out of the range expressed by above Condition (2), the behavior of the toner particles after the separation process may be different from the behavior of the initial toner particles, and, therefore, it is difficult to reuse the separated toner particles in the abovementioned specified image forming method.

Specifically, the particle shape factor C of the toner particles after the separation process is determined by.

obtaining an image of the toner particles at a magnification of 2000 times using a scanning electron microscope (SEM) JSM-7401F (produced by JEOL Ltd.);

loading the image of the toner particles in a LUZEX IMAGE PROCESSOR (produced by NIRECO Corp.); and measuring the maximum particle diameter and the minimum particle diameter of each particle to calculate the particle shape factor by dividing the minimum particle diameter with the maximum particle diameter, followed by averaging the particle shape factors of 100 toner particles to obtain the particle shape factor.

It is also preferable, in the present invention, that the image supporting substrate 11 is separated from the image print P via the separation process.

It is preferable that the toner particles TC separated from the image print P is recyclable as a image forming material, and, also, the image supporting substrate 11C separated from the image print P is recyclable as a image forming material. It is preferable that the toner particles TC and the image supporting substrate 11C separated from the image print P (hereafter, also referred to as "separated toner particles" and "separated image supporting substrate", respectively) are used in the abovementioned specified image forming method. By alternately repeating the abovementioned specified image forming method and the separation process through which separated toner particles and, if necessary, a separated image supporting substrate are obtained, a recycling system by which energy saving is achieved can be obtained.

[Separation Process]

The separation process in which the toner particle and the image supporting substrate 11 are separated from the image print P obtained by the specified image forming method of the present invention can be conducted, for example, by immersing the image print P in a separation liquid which dissolves or swells the material constituting the toner holding layer 15B, but does not dissolve the toner particles and the image supporting substrate 11.

The separation process can also be conducted by, after separating the toner holding layer 15B holding the toner image T from the image print P, by immersing the toner holding layer 15B in a separation liquid which dissolves or swells the material constituting the toner holding layer 15B, but does not dissolve the toner particles.

[Separation Liquid]

In the case when the material constituting the toner holding layer 15B can be dissolved or swelled in water, examples of a separation liquid for separation include: water, methyl alcohol, ethyl alcohol, ethylene glycol, propylene glycol, polyethylene glycols, glycerin, and a mixture thereof. In the case when the material constituting the toner holding layer 15B can be dissolved or swelled in an organic solvent or in an oil, examples of a separation liquid include: toluene, xylene, benzene, carbon tetrachloride, methylene chloride, 1,2-dichloroethane, 1,1,2-trichloroethane, trichloroethylene, chloroform, monochlorobenzene, dichloro ethylidene, methyl acetate, ethylacetate, methyl ethyl ketone, methyl isobutyl ketone, dimethyl-silicone oil, methylphenyl-silicone oil, methyl hydrogen-silicone oil, amino modified silicone oil and commercially available resolvents such as "E CLEAN 21 RG201" (produced by the KANEKO KAGAKU Ltd.), and DYNASOLVE 180, DYNASOLVE 225 and DYNASOLVE 711 (produced by DYNALOY (AR BROWN Co., Ltd.)). However, the present invention is not limited thereto.

Thus, the toner particles and the image supporting substrate 11 which were separated in the state where they were immersed in a separation liquid can be respectively recovered, for example, by using a centrifuge.

The toner particles recovered as described above can be used in the image forming method of the next cycle, for example, by adding the decrement of the external additive mentioned later.

[Measurement of the External Additive in the Toner]

The amount of the external additive in the toner particles can be determined, for example, by using an X ray fluorescence analyzer. Specifically, X ray fluorescence analyzer "XRF-1700" (produced by SHIMADZU Corp.) is usable.

The difference between the energy to form an image print P(N) formed by using toner particles prepared from raw materials by granulation and the energy to form an image print P(R) formed by using the recycled toner particles recovered as above substantially corresponds to the energy difference obtained by subtracting the subtotal of the energy required in the separation process and the energy to add the decrement of the external additive (hereafter, referred to as a recycling energy) from the energy required to granulate the toner particles from raw materials (hereafter, referred to as an initial production energy). A large energy saving effect can be obtained since the recycling energy is extremely smaller that the initial production energy.

[Image Supporting Substrate]

An appropriate material can be used as an image supporting substrate 11 used for the specified image forming method, for example, standard paper including from thin paper to thick paper, high-quality paper, printing paper which is coated such as art paper and coat paper, commercially available Japanese paper and post card paper, polypropylen synthetic paper, a polyethylene terephthalate (PET) film, a polyethylenenaphthalate (PEN) film, a polyimide film and cloth. Of these, preferable are those having high strength which do not lose the property even after a number of repeated recycling. Preferable examples of an image supporting substrate 11 which is subjected to a number of recycling include: standard paper having stiffness, art paper, a polyethylene terephthalate (PET) film, a polyethylenenaphthalate (PEN) film and a polyimide film.

In the present invention, the toner holding layer 15 preferably does not show fluidity when no external force for deformation is applied, but shows fluidity only when an external force for deformation is applied. Further, the toner holding layer 15 preferably shows a drastic change of state when a specific external force for deformation is applied, and then solidified while keeping the deformation of the toner particles due to the specified external force for deformation. As a material which constitutes the toner holding layer 15, a material which is incompatible with the toner resin may be appropriately chosen. As a material which constitutes the toner holding layer 15, a material which is recyclable as an image forming material after subjected to the abovementioned separation process is preferable.

As a material which constitutes the toner holding layer 15, specific examples of a material which shows a rapid change of state by quenching after heating include: materials having a sharp melting property, such as, a polyolefin resin, a polyester resin, an acryl resin, a polystyrene resin, a polyester wax and a polypropylene wax; and materials which show a rapid change of state when irradiated with light, such as, a silicone resin, an acryl resin and an urethane resin. The thickness of the toner holding layer 15 is determined in relation to the thickness of the toner image T to be held in the toner holding layer, and the thickness is, for example, 1-500 μm.

In the specified image forming method, when the toner holding layer 15 itself is adhesive under a normal condition, a surface protective layer may be provided on the top of the toner holding layer 15, in view of storing nature and add-on capability. The surface protective layer may be provided by coating a material having the same composition as the composition of the material constituting the toner holding layer 15, followed by hardening only the coated layer by light, heat or steam; or by coating a material having different composition from the composition of the material constituting the toner holding layer. Examples of the above different composition include: organic solvent soluble resins such as a polystyrene resin, an acrylic resin and a polyester resin; a photo curing agent; a heat curing agent; and a moisture curing agent. A sheet of, for example, polyethylene terephthalate (PET), polyethylene naphthalate (PEN), polypropylen (PP), and polystyrene (PS) may be used to cover the toner holding layer as a surface protective layer.

The toner particles used for the specified image forming method preferably contain a material exhibiting elasticity or a shape memory effect, and specifically, polymer materials such as an elastomer having rubber-like elasticity or a shape memory effect may be cited. Examples of an elastomer having rubber elasticity include rubbers such as a natural rubber and a synthetic rubber, and a thermoplastic elastomer having an alloy structure of a resin and a rubber, which is fluidic at a higher temperature, but plastic deformation is prevented at a normal temperature, and provides a reinforcing effect to a rubber. Examples of an elestomer having rubber elasticity include: a natural rubber containing cis-polyisoprene as a main component; a natural Gutta Percha containing trans-polyisoprene as a main component; acrylic rubbers obtained by addition polymerizating or copolymerizating monomers such as acrylic acid, butylacrylate, 1,3-butadiene, 2-chloro-1,3-butadiene, acrylnitrile, isoprene, chloroprene, styrene, α-methylstyrene, p-chlorostyrene, isobutylene, hexamethyl siloxane, tetrafluoroethylene, isocyanate, oxypropylene glycol, epichlohydrine, ethylene and propylene; synthetic rubbers such as an acrylonitrile-butadiene rubber, an isoprene rubber, a urethane rubber, an ethylene-propylene rubber, an epichlorohydrin rubber, a chloroprene rubber, a silicone rubber, a styrene-butadiene rubber, a butadiene rubber, a fluororubber and a polyisobutylene rubber; a methacrylic acid-butadiene copolymer; an acrylic acid-butadiene copolymer; a methylmethacrylate-methyl butadiene copolymer; a styrene-butadiene copolymer; a styrene-isoprene copolymer; a styrene-ethylene butylene copolymer; a styrene-ethylene propylene copolymer; a styrene-isobutylene copolymer; a methyl vinyl ketone-butadiene copolymer; an olefin-thermoplastic elastomer (TPO, TPV); a vinyl chloride-thermoplastic elastomer (TPVC); an amide-thermoplastic elastomer, an ester-thermoplastic elastomer, and an urethane-thermoplastic elastomer.

As an elastomer which has shape memory effect, for example, a cross-linked shape memory elastomer formed via a physical or chemical cross-linking process, and a networked shape memory elasomer in which a network polymer and a phase transformation polymer are mixed may be cited. Examples of a specific elastomer exhibiting a shape memory effect include:

cross-linked shape memory polymers obtained by polymelizing monomers such as norbornane, styrene, butadiene, isoprene, methylmethacrylate, butylacrylate, ethylene, propylene, acrylic acid, isofluorone diisocyanate and oxypropylene glycol using a cross-linking agent or a chain extender such as par oxyketal, hindered phenol, benzoyl peroxide, 1,4-butanediol and ethylene glycol, cross-linked shape memory polymers obtained by being subjected to a chain extension process after polymerization such as polynorbornene, polyurethane, polyisoprene, polyethylene and a styrene butadiene copolymer; and networked shape memory polymer obtained by mixing networked polymers such as an epoxy resin, a phenol resin, an acrylic resin and a melanin resin, and phase transformation polymers such as polycaprolactone, polyvinylchloride, polystyrene, polybutylene succinate, polyethylene terephthalate, a polybutylene terephthalate and polyphenylene sulfide.

The toner particles may contain a resin which does not show elasticity or a shape memory effect, and, if desired, may contain a colorant, a charge control agent, magnetic particles or a release agent. Hereafter, an aggregate of such toner particles is referred to as "a toner".

Toner particles before use will be explained below.

[Resin Exhibiting No Elasticity Nor Shape Memory Effect]

When toner particles are manufactured, for example, by a pulverization method or an emulsion dispersion method, examples of a resin exhibiting no elasticity nor shape memory effect includes resins other than the above mentioned resins which exhibit elasticity or shape memory effect, and include varieties of well known resins, for example, vinyl resins such as a styrene resin, a (meth)acrylic resin, a styrene-(meth) acrylic copolymer resin and an olefin resin, a polyester resin, a polyamide resin, a polycarbonate resin, a polyether resin, a polyvinyl acetate resin, a polysulfone resin, an epoxy resin, a polyurethane resin and an urea resin. These resins may be used alone or in combination of two or more.

When toner particles are manufactured by, for example, a suspension polymerization method, a dispersion polymerization method, an emulsion polymerization method or an emulsion polymerization agglomeration method, examples of a polymerizable monomer to obtain a resin exhibiting elasticity or a shape memory effect include: styrene and styrene derivatives such as styrene, o-methylstyrene, m-methylstyrene, p-methylstyrene, α-methyl styrene, p-chlorostyrene, 3,4-dichlorostyrne, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecyl styrene; methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate; acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; olefins such as ethylene, propylene and isobutylene; vinyl halogenides such as vinyl chloride, vinylidene chloride, vinyl bromide, vinyl fluoride and vinylidene fluoride; vinyl esters such as vinyl propionate, vinyl acetate and vinyl benzoate; vinyl ethers such as vinyl methyl ether and vinyl ethyl ether; vinyl ketones such as vinyl methyl ketone, vinyl ethyl ketone and vinyl hexyl ketone; N-vinyl compounds such as N-vinylcarbazole, N-vinyl indole and N-vinyl pyrrolidone; and vinyl compounds such as vinyl naphthalene and vinylpyridine; vinyl monomers of acryl derivatives or a methacryl derivatives such as acrylonirile, methacrylonitrile and acrylamide. These vinyl monomers may be used alone or in combination of two or more.

As a polymerizable monomer, one having an ionically dissociable group is preferably used in combination. Polymerizable monomers having an ionically dissociable group include those having a substituent such as a carboxyl group, a sulfonic acid group, and a phosphoric acid group, as a constituting group, and examples of which include: acrylic acid, methacrylic acid, maleic acid, itaconic acid, cinnamic acid, fumaric acid, maleic acid mono-alkyl ester, itaconic acid mono-alkyl ester, styrene sulfonic acid, allylsulfo succinic acid, 2-acrylamide-2-methylpropane sulfonic acid, acidphosphoxyethyl methacrylate and 3-chloro-2-acidphosphoxypropyl methacrylate.

Further, a binder resin having a cross linked structure can be obtained by using a multi-functional vinyl compounds as a polymerizable monomer, for example, divinylbenzne, ethylene glycol dimethacrylate, ethylene glycol diacrylate, diethylene glycol dimethacrylate, diethylene glycol diacrylate, triethylene glycol dimethacrylate, triethylene glycol diacrylate, neopentylglycol dimethacrylate and neopentylglycol diacrylate.

[Colorant]

In the case when the toner contains a colorant, varieties of organic or inorganic pigments of various kinds and various colors as shown below may be used. Namely, examples of a black colorant include: carbon black, copper oxide, manganese dioxide, aniline black, active carbon, nonmagnetic ferrite, magnetic ferrite and magnetite. Examples of a yellow colorant include: chrome yellow, zinc yellow, cadmium yellow, yellow iron oxide, mineral fast yellow, nickel titanium yellow, navel orange yellow, naphthol yellow S, Hansa yellow G, Hansa yellow 10G, benzidine yellow G, benzidine yellow GR, quinoline yellow lake, permanent yellow NCG and tartrazine lake. Examples of an orange pigment include: red chrome yellow, molybdenum orange, permanent orange GTR, the pyrazolone orange, vulcan orange, indathrene brilliant orange RK, benzidine orange G and indathrene brilliant orange GK. Examples of red pigment include: quinacridone, red ocher, cadmium red, minium, mercury sulfide, cadmium, permanent red 4R, lithol red, pyrazolone red, watchung Red, calcium salt, lake red C, lake red D, brilliant carmin 6B, eosine lake, rhodamine lake B, alizarin lake and brilliant carmine 3B. Examples of a purple pigment include: manganese purple, fast violet B, methyl violet lake. Examples of a blue pigment include: Prussian blue, cobalt blue, alkali blue color lake, Victoia blue lake, metal phthalocyanine blue, nonmetal phthalocyanine blue, phthalocyanine-blue partial chlorination, fast sky blue and indathrene blue BC. Examples of a green pigment include: chrome green, chrome oxide, pigment green B, mica light green lake and final yellow green G. Examples of a white pigment include: zinc white, titanium oxide, antimony white and zinc sulfide. Examples of an extender pigment include: barite powder, barium carbonate, clay, silica, white carbon, talc, alumina white, etc. are cited. These pigments may be used alone or in combination of two or more.

The addition amount of a colorant is preferably 0.5-20 mass parts, and more preferably 2-10 mass parts, in 100 mass parts of a toner resin.

[Magnetic Particle]

In the case when magnetic particles are contained in the toner particles, for example, magnetite, γ-hematite or varieties of ferrites may be used as magnetic particles. The addition amount of magnetic particles is preferably 10-500 mass parts, and more preferably 20-200 mass parts, in 100 mass parts of the toner resin.

[Charge Control Agent]

When a charge control agent is contained in the toner particles, the charge control agent is not specifically limited as far as it is possible to provide a positive or negative charge via triboelectric charging, and varieties of well known charge control agents are usable. Specifically, examples of a positive charge control agent include: nigrosine dyes such as NIGROSINE BASE EX (produced by ORIENT CHEMICAL INDUSTRIES Co., Ltd.); quaternary ammonium salts such as Quaternary ammonium salt P-51 (produced by ORIENT CHEMICAL INDUSTRIES Co., Ltd.) and COPY CHARGE PX VP435 (produced by HOECHST JAPAN Co., Ltd.); and imidazole compounds such as an alkoxyamine, an alkylamide, a molybdenate chelate pigment and PLZ1001 (produced by SHIKOKU CHEMICALS Corp.). Examples of a nagative charge control agent include: metal complexes such as BONTRON® S-22 (produced by ORIENT CHEMICAL INDUSTRIES Co., Ltd.), BONTRON® S-34 (produced by ORIENT CHEMICAL INDUSTRIES Co., Ltd.), BONTRON® E-81 (produced by ORIENT CHEMICAL INDUSTRIES Co., Ltd.), BONTRON® E-84 (produced by ORIENT CHEMICAL INDUSTRIES Co., Ltd.) and SPILON BLACK TRH (produced by HODOGAYA CHEMICAL Co., Ltd.); quaternary ammonium salts such as a thioindigo pigment and COPY CHARGE NX VP434 (produced by HOECHST JAPAN Co., Ltd.); carixarene compounds such as BONTRON® E-89 (produced by ORIENT CHEMICAL INDUSTRIES Co., Ltd.); boron-containing compounds such as LR147 (produced by LAPAN CARLIT Co., Ltd.); and fluorine-containing compound such as magnesium fluoride and carbon fluoride.

In addition to the above described materials, other examples of a metal complex used as a negative charge control agent include: compounds having varieties of structures such as a oxycarboxylic acid metal complex, a dicarboxylic acid metal complex, an amino acid metal complex, a diketone metal complex, a diamine metal complex, an azo group-containing benzene-benzene derivative metal complex, and an azo group-containing benzene-naphthalene derivative metal complex. Thus, the chargeability of the toner can be improved by incorporating a charge control agent in the toner particles.

The addition amount of a charge control agent is preferably 0.01-30 mass parts, and more preferably 0.1-10 mass parts, in 100 mass parts of the toner resin.

[Release Agent]

When a release agent is contained in the toner particles, varieties of well known waxes are usable. It is preferable to use polyolefine waxes such as a low molecular weight polypropylene or polypropylene, and an oxidation type polyethylene or polypropylene.

The addition amount of a release agent is preferably 0.1-30 mass parts, and more preferably 1-10 mass parts, in 100 mass parts of the toner resin.

[Manufacturing Method of Toner Particles]

The manufacturing method of such toner particles is not specifically limited, and a pulverization method, an emulsion dispersion method, a suspension polymerization method, a dispersion polymerization method, an emulsion polymerization method, an emulsion polymerization agglomeration method and other known methods may be cited.

[Particle Diameter of Toner Particles]

The volume median diameter of the toner particles is preferably 3-8 μm. When the volume medial diameter is 3-8 μm, an excellent reproducibility of a thin-line and a high quality picture image can be obtained, as well as the consumption of toner particles can be reduced compared with when larger diameter toner particles are used.

The volume median diameter of toner particles is measured and calculated using a measurement device of "COULTER MULTISIZER 3 (produced by BECKMAN COULTER, Inc.) connected with a data processing computer system installed with a data processing software "SOFTWARE V3.51" (produced by BECKMAN COULTER, Inc.). Specifically, 0.02 g of the toner is added in 20 ml of a surfactant solution (a surfactant solution prepared, for example, via ten-fold dilution of a neutral detergent containing a surfactant composition with purified water in order to disperse the toner particles), followed by being wetted and then subjected to ultrasonic dispersion for 1 minute to prepare a toner particles dispersion. The toner particles dispersion is injected into a beaker set on the sample stand, containing "ISOTON II" (produced by BECKMAN COULTER, Inc.), using a pipette until the concentration indicated by the measurement device reaches 8%. This concentration makes it possible to obtain reproducible measurement values. Then, a measured particle count number and an aperture diameter are adjusted to 25000 and 50 μm, respectively, in the measurement device, and a frequency value is calculated by dividing a measurement range of 1-30 μm into 256 parts. The particle diameter at the 50% point from the higher side of the volume accumulation fraction is designated as the volume median diameter.

[Average Circularity of Toner Particles]

The average circularity defined by the following Scheme (S) of the toner particles described so far is preferably 0.700 to 1.000, and more preferably, of 0.850 to 1.000.

Scheme (S):

Average circularity=(circumferential length of a circle having the same projective area as that of a particle image)/(circumferential length of the projective particle image)

[External Additive]

The above described toner particles themselves can constitute the toner according to the present invention. However, to improve fluidity, chargeability, and cleaning properties, the toner particles may be added with an external additive, for example, a fluidizer which is so-called a post-treatment agent, or a cleaning aid, to form the toner.

The post-treatment agent includes, for example, inorganic oxide particles such as silica particles, alumina particles, or titanium oxide particles; inorganic-stearate particles such as aluminum stearate particles or zinc stearate particles; or inorganic titanate particles such as strontium titanate or zinc titanate. These can be used alone or in combination of at least 2 types.

These inorganic particles are preferably subjected to surface treatment with a silane coupling agent, a titanium coupling agent, a higher fatty acid, or silicone oil to enhance heat-resistant storage stability and environmental stability.

The total addition amount of these various external additives is 0.05-5 mass parts, preferably 0.1-3 mass parts in 100 mass parts of the toner. Further, various appropriate external additives may be used in combination.

[Developer]

The toner according to the present invention may be used as a magnetic or non-magnetic single-component toner or a two-component toner by mixing with carriers. When the toner is used as a single-component developer, magnetic particles of a diameter of 0.1-0.5 μm are incorporated in a non-magnetic single-component developer or in a toner, both of which are usable. When the toner is used as a two-component toner, it is possible to use, as a carrier, magnetic particles conventionally known in the art, including metals such as iron, ferrite, or magnetite, as well as alloys of the above metals with metals such as aluminum or lead, but ferrite particles are specifically preferable. Further, it is also possible to use, as the carrier, coated carriers in which the surface of magnetic particles is coated with a coating agent such as a resin; or binder-dispersed carriers composed of magnetic particles dispersed in a binder resin.

According to the above method of recycling an image forming material, basically, energy saving can be attained because a toner image T is fixed on an image supporting substrate 11 without heat;

the surface of the image print P exhibits a highly homogeneous state because obtained image print P has a toner holding layer 15 and the toner image T is held in the toner holding layer 15; whereby light scattering at the surfaces of the toner particles is suppressed;

the toner image exhibits high smoothness because the toner particles forming the toner image T are tightly adhered with each other, whereby a high quality image can be obtained; and a large energy saving effect as a whole can be obtained because toner particles and an image supporting substrate 11 can be separated as image forming materials which can be recycled from the image print P.

The embodiments of the present invention have been specifically explained as above, however, the present invention is not limited thereto, and various modifications may be added. For example, the specified image forming method is not limited to the abovementioned first image forming method, and a following second image forming method is also applicable.

<A Second Image Forming Method>

Figure 5A:
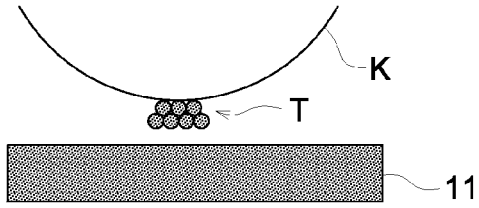
FIG. 5*a* is a schematic illustration explaining an example of a modified image forming method relating to the present invention illustrating a state in which a toner image is formed on a photoreceptor.
Figure 5B:
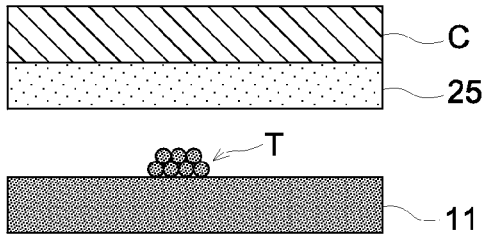
FIG. 5*b* is a schematic illustration explaining the example of the modified image forming method relating to the present invention illustrating a state in which the toner image is carried on an image supporting substrate.
Figure 5C:
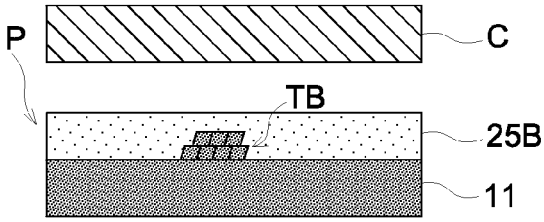
FIG. 5*c* is a schematic illustration explaining the example of the modified image forming method relating to the present invention illustrating a state in which the toner image is held in the toner holding layer.
Figure 5D:
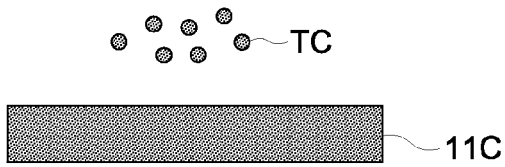
FIG. 5*d* is a schematic illustration explaining the example of the modified image forming method relating to the present invention illustrating an image supporting substrate and a toner, after being subjected to a separation process.
Figure 6:
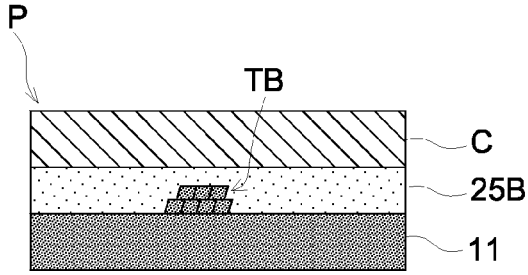
FIG. 6 is an illustration showing an example in which another substrate is used to form a surface protective layer in the image forming method illustrated in FIGS. 5*a* to 5*d*.

As shown in FIGS. 5*a*-5*d*, a second image forming method is carried out in a similar manner to the first image forming method except that, after the toner image T electrostatically formed on the photoreceptor K is carried on the image supporting substrate 11, a toner holding layer 25 laminated on another substrate C is over laid, followed by burying the toner image T into the toner holding layer 25 with accompanying the deformation of the toner holding layer 25 with a specified external force for deformation, whereby the toner image TB is fixed. The another substrate C may be peeled from the image print P as shown in FIG. 5*c*, or may be a part of the image print P, as shown in FIG. 6, using a transparent material such as a PET film.

When the image forming method explained above is used, a similar effect to when the method of recycling an image forming material according to the first image forming method is used.

EXAMPLES

Specific examples of the present invention will be described below, however, the present invention is not limited thereto.

Synthetic Example of Toner Particles 1

(1) Preparation of Colorant Particle Dispersion Liquid

In a surfactant solution prepared by dissolving 2.5 parts by mass of sodium n-dodecylsulfate in 1600 parts by mass of deionized water, 200 parts by mass of a copper phthalocyanine pigment was added gradually while stirring the surfactant solution, followed by an dispersion treatment using a sand grinder produced by IMEX Co., Ltd. to obtain a colorant particle dispersion [1] in which colorant particles having a volume average particle diameter of 189 nm were dispersed. The volume average particle diameter of the particles in the dispersion was determined by UPA-150 produced by NIKKISO Co., Ltd.

(2) Preparation of Toner

To a vessel having a stirrer, a heating/cooling device, a nitrogen introducing device and a raw material-assisting agent charging device, a surfactant solution prepared by dissolving 4 parts by mass of sodium dodecylsulfonate in 2,800 parts by mass of deionized water was charged and the internal temperature was raised to 50° C. while stirring at a stirring rate of 200 rpm under a nitrogen flow. To the solution, a polymerization initiator solution prepared by dissolving 10 parts by mass of potassium persulfate in 400 parts by mass of deionized water was added and then a monomer mixture composed of 560 parts by mass of 1,3-butadiene, 120 parts by mass of lauryl methacrylate and 40 parts by mass of acrylonitrile was dropped spending 90 minutes, and polymerized by keeping the temperature for 120 minutes to prepare a rubber particle dispersion [G1'] in which rubber particles [G1] were emulsion dispersed.

Further, to a vessel having a stirrer, a heating/cooling device, a nitrogen introducing device and a raw material-assisting agent charging device, 1,300 parts by mass of deionized water, 790 parts by mass of the foregoing rubber particle dispersion [G1'] and 163 parts by mass of foregoing colorant particle dispersion [1] were charged and the pH value of the resulting liquid was adjusted to 10 by adding a 5M aqueous solution of sodium hydroxide while stirring at a stirring rate of 200 rpm. Subsequently, to the resultant liquid, a solution prepared by dissolving 27 parts by mass of magnesium chloride 6 hydrate in 27 parts by mass of deionized water was added, the temperature was raised to 88° C. and a particle growth reaction was maintained.

At the moment when the volume average particle diameter of the associated particles reached at 8.7 μm, a solution prepared by dissolving 67 parts by mass of sodium chloride in 270 parts by mass of deionized water was added to sop the growth of the particles, and then the particles were subjected to a treatment of making sphere shape, while continuing heating. The liquid was then cooled and repeatedly subjected to filtration and washing, followed by drying, to obtain toner mother particles [1] having a volume average particle diameter of 8.6 μm.

To 100 parts by mass of the toner mother particle [1], 0.5% by mass of silica particle H-2000, manufactured by Hoechst Japan Ltd., and 1% by mass of titanium dioxide particle T-805, manufactured by Nihon Aerosil Co., Ltd. were added and treated by HENSCHEL MIXER (produced by MITSUI MINING Co., Ltd.) to obtain toner [1] employing toner mother particles [1].

In the foregoing processes, the volume average particle diameters of the particles in the toner mother particles [1] were determined by COULTER MULTISIZER, manufactured by BECKMAN COULTER Inc. With respect to the toner mother particles [1], the shape and diameter were not changed by the addition of silica particles and titanium dioxide particles, which was the same also in the following examples.

Synthetic Example of Toner Particles 2

To a vessel having a stirrer, a heating/cooling device, a nitrogen introducing device and a raw material-assisting agent charging device, a surfactant solution prepared by dissolving 4 parts by mass of sodium dodecylsulfonate in 2,800 parts by mass of deionized water was charged and the internal temperature was raised to 50° C. while stirring at a stirring rate of 200 rpm under a nitrogen flow. To the solution, a polymerization initiator solution prepared by dissolving 10 parts by mass of potassium persulfate in 400 parts by mass of deionized water was added and then a monomer mixture composed of 150 parts by mass of styrene, 580 parts by mass of 1,3-butadiene and 20 parts by mass of lauryl methacrylate was dropped spending 90 minutes, followed by polymerizing while keeping the temperature for 120 minutes. The product was subjected to repeated filtration and washing and then dried to obtain rubber particles [G2].

Then, 500 parts by mass of rubber particles [G2], 25 parts by mass of carbonblack and 1 part by mass of sulfur were mixed and kneaded at 120° C. in a kneader, followed by expanding, cooling and cutting to form particles of which length is 8.2 μm. Thus, toner mother particles [2] were obtained.

To 100 parts by mass of the toner mother particles [2], 0.5% by mass of silica particle H-2000, manufactured by Hoechst Japan Ltd., and 1% by mass of titanium dioxide particle T-805, manufactured by Nihon Aerosil Co., Ltd. were added and treated by HENSCHEL MIXER (produced by MITSUI MINING Co., Ltd.) to obtain toner [2] employing the toner mother particles [2].

Synthetic Example of Toner Particles 3

To a vessel having a stirrer, a heating/cooling device, a nitrogen introducing device and a raw material-assisting agent charging device, 250 parts by mass of isophorone diisocyanate and 100 parts by mass of oxypropylene glycol were charged and the mixture was stirred. Then, 50 parts by mass of 1,4-butanediol was added to the mixture and the mixture was kept stirring, whereby shape memory polymer [K1] having a shape memory temperature of 50° C. was obtained.

Then, 95 parts by mass of shape memory polymer [K1] and 5 parts by mass of carbonblack were kneaded in a kneader at 70° C. The product was expanded, cut, cooled and then heated to 50° C., whereby toner mother particles [3] having a volume average particle diameter of 7.3 μm was obtained.

To 100 parts by mass of the toner mother particles [3], 0.5% by mass of silica particle H-2000, manufactured by Hoechst Japan Ltd., and 1% by mass of titanium dioxide particle T-805, manufactured by Nihon Aerosil Co., Ltd. were added and treated by HENSCHEL MIXER (produced by MITSUI MINING Co., Ltd.) to obtain toner [3] employing the toner mother particles [3].

Synthetic Example of Toner Particles 4

Ninety five parts by mass of styrene-butadiene copolymer (manufactured by ASAHI KASEI Corp., shape memory temperature: 120° C. or more, shape recovery temperature: 60-90° C.) and 5 parts by mass of carbonblack were melt-kneaded at 150° C. in a two-screw extruder, pulverized and powdered using a jet-mill, and classified using a classifier to obtain toner mother particles [4] having a volume average particle diameter of 15 μm.

To 100 parts by mass of the toner mother particles [4], 0.5% by mass of silica particle H-2000, manufactured by Hoechst Japan Ltd., and 1% by mass of titanium dioxide particle T-805, manufactured by Nihon Aerosil Co., Ltd. were added and treated by HENSCHEL MIXER (produced by MITSUI MINING Co., Ltd.) to obtain toner [4] employing the toner mother particles [4].

Synthetic Example of Toner Particles 5

(1) Preparation of Colorant Particle Dispersion Liquid

In a surfactant solution prepared by dissolving 2.5 parts by mass of sodium dodecylsulfate in 1600 parts by mass of deionized water, 400 parts by mass of a quinacridone pigment was added gradually while stirring the surfactant solution, followed by a dispersion treatment using a sand grinder produced by IMEX Co., Ltd. to obtain a colorant particle dispersion [2] in which colorant particles having a volume average particle diameter of 215 nm were dispersed. The volume average particle diameter of the particles in the dispersion was determined by UPA-150 produced by NIKKISO Co., Ltd.

(2) Preparation of Toner

To a vessel having a stirrer, a heating/cooling device, a nitrogen introducing device and a raw material-assisting agent charging device, a surfactant solution prepared by dissolving 4 parts by mass of sodium dodecylsulfonate in 2,800 parts by mass of deionized water was charged and the internal temperature was raised to 80° C. while stirring at a stirring rate of 200 rpm under a nitrogen flow. To the solution, a polymerization initiator solution prepared by dissolving 10 parts by mass of potassium persulfate in 400 parts by mass of deionized water was added and then a monomer mixture composed of 530 parts by mass of styrene, 200 parts by mass of n-butyl acrylate, 70 parts by mass of methacrylic acid and 16 parts by mass of n-octylmercaptan was dropped spending 90 minutes and polymerized by keeping the temperature for 120 minutes to prepare a latex (Lx1).

To a monomer liquid composed of 116 parts by mass of styrene, 47 parts by mass of n-butyl acrylate and 12 parts by weigh of n-octylmercaptan, 70 parts by mass of polyethylene wax was added and dissolved at 80° C. to prepare a monomer solution. On the other hand, a surfactant solution prepared by dissolving 3 parts by mass of sodium dodecylsulfonate in 700 parts by mass of deionized water was heated to 80° C. and mixed with the above monomer solution. And then, the mixture was treated for 30 minutes by a mechanical dispersing machine CLEARMIX, produced by M TECH Co., Ltd., to prepare an emulsified dispersion [1].

To a vessel having a stirrer, a heating/cooling device, a nitrogen introducing device and a raw material-assisting agent charging device, 1,700 parts by mass of deionized water and 160 parts by mass of the foregoing latex [Lx1] were charged and the internal temperature was raised by 80° C. while stirring at a stirring rate of 200 rpm under a nitrogen atmosphere. To the resultant liquid, the foregoing emulsified dispersion and a solution prepared by dissolving 6 parts by mass of potassium persulfate in 240 parts by mass of deionized water were added and polymerized for 2 hours to obtain a latex [Lx2].

To the latex [Lx2], a solution prepared by dissolving 5 parts by mass of potassium persulfate in 220 parts by mass deionized water was added, and a monomer mixture liquid composed of 338 parts by mass of styrene, 110 parts by mass of n-butyl acrylate and 7 parts by mass of n-octylmercaptan was dropped spending 90 minutes and polymerized by holding the temperature for 120 minutes to obtain a latex [Lx3] having a volume average particle diameter of 156 nm.

Further, to a vessel having a stirrer, a heating/cooling device, a nitrogen introducing device and a raw material-assisting agent charging device, 1,300 parts by mass of deionized water, 790 parts by mass of the foregoing latex [Lx3] and 163 parts by mass of the foregoing colorant particles dispersion [2] were charged and the pH value of the liquid was adjusted to 10 by adding a 5 M sodium hydroxide solution, while stirring at a stirring rate of 200 rpm. To the resultant liquid, a solution prepared by dissolving 27 parts by mass of magnesium chloride 6 hydrate in 27 parts by mass of deionized water was added and the temperature of the liquid was raised to 86° C. to continue the grain growing reaction while keeping the temperature. At the moment when the volume average particle diameter of the associated particles reached at 6.6 μm, a solution prepared by dissolving 67 parts by mass of sodium chloride in 270 parts by mass of deionized water was added to sop the growth of the particles, and then the particles were subjected to a treatment of making sphere shape having an average circularity of 0.94, while continuing heating. The liquid was then cooled and repeatedly subjected to filtration and washing, followed by drying, to obtain toner mother particles [5] having a volume average particle diameter of 6.4 μm.

To 100 parts by mass of the toner mother particle [5], 0.5% by mass of silica particle H-2000, manufactured by Hoechst Japan Ltd., and 1% by mass of titanium dioxide particle T-805, manufactured by Nihon Aerosil Co., Ltd. were added and treated by HENSCHEL MIXER (produced by MITSUI MINING Co., Ltd.) to obtain toner [5] employing toner mother particles [5].

In the foregoing processes, the volume average particle diameters of the particles in the latex [Lx3] and toner mother particles [5] were determined by COUL MULTISIZER, manufactured by BECKMAN COULTER Inc., and the average circularity of the toner particles was measured by a flow type particle image analyzing apparatus FPIA-2000, manufactured by SYSMEX Corp. With respect to the toner mother particles [5], the shape and diameter were not changed by the addition of silica particles and titanium dioxide particles.

Examples of Preparation of Developers 1-5

Two component developers [1]-[5] were prepared by mixing each of toners [1]-[5] with an acryl coated silicone carrier in a mass ratio of 6:94.

Example 1

A toluene solution of 30% by mass of a polyester resin (Tg=−20° C.) was applied on an image supporting substrate [1] constituted of a white polyethylene terephthalate (PET) plate, followed by drying, to form an image carrier [1] having a toner holding layer of which thickness is 20 μm.

On this image carrier [1], a toner image was formed by "BIZHUB C 253" (produced by Konica Minolta Business Technologies, Inc.) from which the fixing device was removed, employing developer [1], and then the image carrier [1] was pressed at an external force of $1.6\times10^5$ by passing the image carrier [1] through a roller heated at 50° C., followed by immediate contact with a cooling board cooled with ice, whereby an image print [1] was obtained. The extent of the change in the particle shape factor (B/A) of the image carrier [1] was shown in Table 1.

When the fixing ratio on this image print [1] was calculated by measuring the fixing strength via the following cloth rubbing method, the fixing ratios was 80% or more, and thus the fixing of the toner image was confirmed. The toner image was considered to be fixed when the fixing ratio was 80% or more. In Table 1, the "fixing" was evaluated as "A" when the fixing ratio was 80% or more, while the "fixing" was evaluated as "B" when the fixing ratio was less than 80%.

Cloth Rubbing Method:

1) measuring the absolute reflection density $D_0$ in an imaging area;
2) pressing a flannel cloth against an imaging area at a pressure of 1 kPa;
3) rubbing 3.5 times back and forth on the imaging area;
4) removing the flannel cloth;
5) measuring the absolute reflection density $D_1$ after removing the flannel cloth;
6) calculating a fixing ratio based on the following formula (N), $$\text{Fixing ratio (\%)}=D_1/D_0\times100 \qquad \text{Formula (N):}$$

A reflection densitometer "RD-918" (produced by MACBETH) was used for measuring an absolute reflection density.

The image print [1] was immersed in methylethyl ketone (MEK)/ethanol (80/10 in mass ratio) and ultrasound was applied to separate and remove the image supporting substrate [1] constituted of white PET. Subsequently, the toner particles, the external additive, and a MEK/ethanol solution of the polyester resin were separated with a centrifuge, and the toner particles and the external additive were recovered. The recovery of the toner particles from the image print [1] was 98% in mass conversion.

The amounts of external additives in the recovered toner particles were measured by determining the amounts of silica particles and titanium oxide particles using an X ray fluorescence analyzer. The residual amounts of the silica particles and the titanium dioxide particles were 63% and 78%, respectively, based on the initial amounts. The recycling developer [1-2] containing the recycling toner [1-2] using the recycling toner particles [1-2] was obtained by adding the external additive of the insufficiency from initial toner particles, and mixing with a HENSCHEL MIXER (produced by MITSUI MINING Co., Ltd.).

Further, recycling image supporting substrate [1-2] was obtained by washing and drying the separated image supporting substrate [1] by applying ultrasound. The extent of the change in the particle shape factor between the toner particles [1] and the toner particles [1-2] (C/A) was shown in Table 1.

An image print [1-2] was obtained in the same manner as described for the image print [1] according to Example 1 employing the recycling developer [1-2] and recycling image supporting substrate [1-2]. No difference in the image quality was observed in a visual observation between the initial image print [1] and the image print [1-2].

Example 2

A melted polypropylene wax (Tg=51° C.) was applied on a image supporting substrate [2] composed of a synthetic polypropylene paper using a bar coater, followed by cooling, to obtain an image carrier [2] having a 50 μm thick toner holding layer.

On this image carrier [2], a toner image was formed by "BIZHUB C 253" (produced by Konica Minolta Business Technologies, Inc.) from which the fixing device was removed, employing developer [2], and then the image carrier [2] was pressed at an external force of $1.6\times10^5$ by passing the image carrier [2] through a roller heated at 53° C., followed by immediate contact with a cooling board cooled with ice, whereby an image print [2] was obtained. The extent of the change in the particle shape factor (B/A) of the image print [2] was shown in Table 1. When the fixing strength in the image print [2] was measured in the same manner as described in Example 1, it was confirmed that the toner image was fixed.

The image print [2] was heated at 60° C. to remove the image supporting substrate [2] composed of a synthetic polypropylene paper, and, while keeping the temperature at 60° C., the toner particles, the external additive and the wax were separated by a centrifuge to recover the toner particles and the external additive. The recovery of the toner particles from the image print [2] was 97% in mass conversion.

The amounts of external additives in the recovered toner particles were measured by determining the amounts of silica particles and titanium oxide particles using an X ray fluorescence analyzer. The residual amounts of the silica particles and the titanium dioxide particles were 18% and 23%, respectively, based on the initial amounts. The recycling developer [2-2] containing the recycling toner [2-2] using the recycling toner particles [2-2] was obtained by adding the external additive of the insufficiency from initial toner particles, and mixing with a HENSCHEL MIXER (produced by MITSUI MINING Co., Ltd.).

Further, recycling image supporting substrate [2-2] was obtained by washing and drying the separated image supporting substrate [2] by applying ultrasound. The extent of the change in the particle shape factor between the toner particles [2] and the toner particles [2-2] (C/A) was shown in Table 1.

An image print [2-2] was obtained in the same manner as described for the image print [2] according to Example 2 employing the recycling developer [2-2] and recycling image supporting substrate [2-2]. No difference in the image quality was observed in a visual observation between the initial image print [2] and the image print [2-2].

Example 3

A silicone resin was applied on a surface protective substrate [3] composed of a polyethylene terephthalate (PET) film using a bar coater and then hardened by being irradiated with ultraviolet rays until a soft gel was obtained, whereby a protective film [3] having a 20 μm thick toner holding layer was obtained. On an image supporting substrate [3] composed of a coat paper, a toner image was formed by "BIZHUB C 253" (produced by Konica Minolta Business Technologies, Inc.) from which the fixing device was removed, employing developer [1]. On this toner image, the protective film [3] was laminated so that the toner image becomes in contact with the silicone resin and pressed with a roller at an external pressure of $1.5\times10^5$ Pa while being irradiated with ultraviolet rays from the back side surface of the polyethylene terephthalate (PET) film to further harden the silicone resin. Thus, an image print [3] was obtained. The extent of the change in the particle shape factor (B/A) of the image print [3] was shown in Table 1. When the fixing ratio in the image print [3] was measured in the same manner as described in Example 1, it was confirmed that the toner image was fixed.

After the image supporting substrate [3] composed of a coat paper was removed from the image print [3], the protective film [3] holding the toner image was immersed in methylethyl ketone (MEK)/ethanol (50/50 in mass ratio) and ultrasound was applied to separate and remove the surface protective film [3] composed of a PET film. Subsequently, the toner particles, the external additive, and a MEK/ethanol solution of the silicone resin were separated with a centrifuge, and the toner particles and the external additive were recovered. The recovery of the toner particles from the image print [3] was 90% in mass conversion.

The amounts of external additives in the recovered toner particles were measured by determining the amounts of silica particles and titanium oxide particles using an X ray fluorescence analyzer. The residual amounts of the silica particles and the titanium dioxide particles were 29% and 32%, respectively, based on the initial amounts. The recycling developer [1-3] containing the recycling toner [1-3] using the recycling toner particles [1-3] was obtained by adding the external additive of the insufficiency from initial toner particles, and mixing with a HENSCHEL MIXER (produced by MITSUI MINING Co., Ltd.).

Further, recycling surface protective substrate [3-2] was obtained by washing and drying the separated surface protective substrate [3] separated by applying ultrasound. The peeled image supporting substrate [3] was used as image supporting substrate [3-2] as it was. The extent of the change in the particle shape factor between the toner particles [1] and the toner particles [1-3] (C/A) was shown in Table 1.

An image print [3-2] was obtained in the same manner as described for the image print [3] according to Example 3 employing the recycling developer [1-3] and recycling image supporting substrate [3-2] and the recycling surface protective substrate [3-2]. No difference in the image quality was observed in a visual observation between the initial image print [3] and the image print [3-2].

Example 4

A silicone resin was applied on a surface protective substrate [4] composed of a polyethylene terephthalate (PET) film using a bar coater and then hardened by being irradiated with ultraviolet rays until a soft gel was obtained, whereby a protective film [4] having a 20 μm thick toner holding layer was obtained. On an image supporting substrate [4] composed of a coat paper, a toner image was formed by "BIZHUB C 253" (produced by Konica Minolta Business Technologies, Inc.) from which the fixing device was removed, employing developer [1]. On this toner image, the protective film [4] was laminated so that the toner image becomes in contact with the silicone resin and pressed with a roller at an external pressure of $1.5\times10^6$ Pa while being irradiated with ultraviolet rays from the back side surface of the polyethylene terephthalate (PET) film to further harden the silicone resin. Thus, an image print [4] was obtained. The extent of the change in the particle shape factor (B/A) of the image print [4] was shown in Table 1. When the fixing ratio in the image print [4] was measured in the same manner as described in Example 1, it was confirmed that the toner image was fixed.

After the image supporting substrate [4] composed of a coat paper was removed from the image print [4], the protective film [4] holding the toner image was immersed in methylethyl ketone (MEK)/ethanol (50/50 in mass ratio) and ultrasound was applied to separate and remove the surface protective substrate [4] composed of a PET film. Subsequently, the toner particles, the external additive, and a MEK/ethanol solution of the silicone resin were separated with a centrifuge, and the toner particles and the external additive were recovered. The recovery of the toner particles from the image print [4] was 90% in mass conversion.

The amounts of external additives in the recovered toner particles were measured by determining the amounts of silica particles and titanium oxide particles using an X ray fluorescence analyzer. The residual amounts of the silica particles and the titanium dioxide particles were 29% and 32%, respectively, based on the initial amounts. The recycling developer [1-4] containing the recycling toner [1-4] using the recycling toner particles [1-4] was obtained by adding the external additive of the insufficiency from initial toner particles, and mixing with a HENSCHEL MIXER (produced by MITSUI MINING Co., Ltd.).

Further, recycling surface protective substrate [4-2] was obtained by washing and drying the separated surface protective substrate [4] separated by applying ultrasound. The peeled image supporting substrate [4] was used as image supporting substrate [4-2] as it was. The extent of the change in the particle shape factor between the toner particles [1] and the toner particles [1-4] (C/A) was shown in Table 1.

An image print [4-2] was obtained in the same manner as described for the image print [4] according to Example 3 employing the recycling developer [1-4] and recycling image supporting substrate [4-2] and the recycling surface protective film [4-2]. No difference in the image quality was observed in a visual observation between the initial image print [4] and the image print [4-2].

Example 5

A toluene solution of 30% by mass of a polyester resin (Tg=−20° C.) was applied on an image supporting substrate [5] composed of a white polyethylene terephthalate (PET) film, followed by drying, to form an image carrier [5] having a toner holding layer of which thickness is 20 μm.

On this image carrier [5], a toner image was formed by "BIZHUB C 253" (produced by Konica Minolta Business Technologies, Inc.) from which the fixing device was removed, employing developer [3], and then the image carrier [5] was pressed by passing the image carrier [5] through a roller heated at 50° C., followed by immediate contact with a cooling board cooled with ice, whereby an image print [5] was obtained. The extent of the change in the particle shape factor (B/A) of the image carrier [5] was shown in Table 1. When the fixing strength in the image print [5] was measured in the same manner as described in Example 1, it was confirmed that the toner image was fixed.

The image print [5] was immersed in methylethyl ketone (MEK)/ethanol (80/10 in mass ratio) and ultrasound was applied to separate and remove the image supporting substrate [5] composed of a white PET film. Subsequently, the toner particles, the external additive, and a MEK/ethanol solution of the polyester resin were separated with a centrifuge, and the toner particles and the external additive were recovered. The recovery of the toner particles from the image print [5] was 98% in mass conversion.

The amounts of external additives in the recovered toner particles were measured by determining the amounts of silica particles and titanium oxide particles using an X ray fluorescence analyzer. The residual amounts of the silica particles and the titanium dioxide particles were 63% and 78%, respectively, based on the initial amounts. The recycling developer [3-2] containing the recycling toner [3-2] using the recycling toner particles [3-2] was obtained by adding the external additive of the insufficiency from initial toner particles, and mixing with a HENSCHEL MIXER (produced by MITSUI MINING Co., Ltd).

Further, recycling image supporting substrate [5-2] was obtained by washing and drying the separated image supporting substrate [5] separated by applying ultrasound. The extent of the change in the particle shape factor between the toner particles [3] and the toner particles [3-2] (C/A) was shown in Table 1.

An image print [5-2] was obtained in the same manner as described for the image print [5] according to Example 5 employing the recycling developer [3-2] and recycling image supporting substrate [5-2]. No difference in the image quality was observed in a visual observation between the initial image print [5] and the image print [5-2].

Comparative Example 1

On a "J paper" produced by Konica Minolta Business Solutions, Inc., a toner image was formed by BIZHUB C 253 (produced by Konica Minolta Business Technologies, Inc) from which the fixing device was removed, employing the developer [5]. The obtained J paper was passed through the removed fixing device with a fixing temperature of 180° C. to obtain a comparative image print [6].

The extent of the change in the particle shape factor (B/A) in the comparative image print [6] was shown in Table 1. When the fixing ratio of the image print [6] was calculated in the same manner as described in Example 1, it was confirmed that the toner image was fixed.

The image print [6] was immersed in water and ultrasound was applied to the image print [6], however, it was found that the paper and the toner particles could not be separated.

Comparative Example 2

Image supporting substrate [X] was produced by cutting a toner accepting portion of a width of 100 μm and a depth of 50

μm according to the desired image on an A4 sized PET sheet having a thickness of 500 μm. In the toner accepting portion of the image supporting substrate [X], the developer [5] was supplied to obtain a comparative image print [7].

The extent of the change in the particle shape factor (B/A) in the comparative image print [7] was shown in Table 1. When the fixing strength of the comparative image print [7] was measured via a cloth rubbing method in the same manner as described in Example 1, exfoliation of toner particles was observed and the fixing ratio was determined to be low.

By sweeping this image print [7] with a brush, the image print was separated into toner particles and the i supporting substrate [X], whereby the toner particles and the supporting substrate [X] were recovered. The recovery of the toner particles from the image print [7] was 99% in mass conversion.

The amounts of external additives in the recovered toner particles were measured by determining the amounts of silica particles and titanium oxide particles using an X ray fluorescence analyzer. The residual amounts of the silica particles and the titanium dioxide particles were 92% and 89%, respectively, based on the initial amounts. The recycling developer [5-2] containing the recycling toner [5-2] using the recycling toner particles [5-2] was obtained by adding the external additive of the insufficiency from initial toner particles, and mixing with a HENSCHEL MIXER (produced by MITSUI MINING Co., Ltd.).

An image supporting substrate [X-2] for recycling was obtained by washing and drying the image supporting substrate [X] obtained by removing the toner particles. The extent of the change in the particle shape factor between the toner particles [5] and the toner particles [5-2] (C/A) was shown in Table 1.

An image print [7-2] was obtained in the same manner as described for the image print [7] in Comparative example 2 employing the recycling developer [5-2] and the recycling image supporting substrate [7-2]. No difference in the image quality was observed in a visual observation between the initial image print [7] and the image print [7-2].

Comparative Example 3

On a "J paper" produced by Konica Minolta Business Solutions, Inc., a toner image was formed by BIZHUB C 253 (produced by Konica Minolta Business Technologies, Inc.) from which the fixing device was removed, employing the developer [4]. The obtained J paper was passed through the removed fixing device with a fixing temperature of 180° C. to obtain a comparative image print [8].

The extent of the change in the particle shape factor (B/A) in the comparative image print [8] was shown in Table 1. When the fixing strength of the comparative image print [8] was measured via a cloth rubbing method in the same manner as described in Example 1, exfoliation of toner particles was observed and the fixing ratio was determined to be low.

The image print [8] was heated at 80° C. in a constant temperature oven and then quenched, whereby a shape recovery treatment was conducted. When the print image was subjected to an exfoliation treatment using a cleaning brush, the toner particles on the surface of the paper could be easily removed and could be separated into the toner particles and the paper. Thus, the toner particles and the paper were recovered. The recovery ratio of the toner particles from the image print [8] was 75% in volume conversion. The paper could be brought into the recyclable condition by deleting the image.

The amounts of external additives in the recovered toner particles were measured by determining the amounts of silica particles and titanium oxide particles using an X ray fluorescence analyzer. The residual amounts of the silica particles and the titanium dioxide particles were 91% and 95%, respectively, based on the initial amounts. The recycling developer [4-2] containing the recycling toner [4-2] using the recycling toner particles [4-2] was obtained by adding the external additives of the insufficiency from those in the initial toner particles, and mixing with a HENSCHEL MIXER (produced by MITSUI MINING Co., Ltd.).

Further, a recycling paper [J-2] was obtained by washing and drying the paper from which the image was deleted. The extent of the change in the particle shape factor between the toner particles [4] and the toner particles [4-2] (C/A) was shown in Table 1.

An image print [8-2] was obtained in the same manner as described for the image print [8] in Comparative example 3 employing the recycling developer [4-2] and the recycling image supporting substrate [J-2]. The image print [8-2] showed a lower image density and a rougher image in visual observation when compared with those of the initial image print [8].

The electric energies necessary to obtain each of the image prints of Examples 1-5 and Comparative examples 1-3, the "possible" or "impossible" to recycle toner particles and the image supporting substrate, the fixing strength and the white turbidity, which will be described below, of the image area of each obtained image print were evaluated. The results were listed in Table 1.

[White Turbidity]

The obtained Image prints were visually evaluated with respect to "White turbidity" by 20 observers. The evaluation criteria were as follows:

A all of the 20 observers evaluated to be "no white turbidity";

B 15 or more but less than 20 observers evaluated to be "no white turbidity";

C 10 or more but less than 15 observers evaluated to be "no white turbidity"; and D less than 10 observers evaluated to be "no white turbidity".

TABLE 1

| | Electric energy (Wh) | B/A | Fixing | White turbidity | C/A | Recycling: Toner particles | Recycling: Image supporting substrate |
|---|---|---|---|---|---|---|---|
| Example 1 | 0.067 | 0.87 | A | A | 0.98 | Possible | Possible |
| Example 2 | 0.081 | 0.72 | A | A | 0.95 | Possible | Possible |
| Example 3 | 0.096 | 0.53 | A | A | 0.97 | Possible | Possible |
| Example 4 | 0.097 | 0.13 | A | A | 0.94 | Possible | Possible |
| Example 5 | 0.091 | 0.35 | A | A | 0.92 | Possible | Possible |
| Comparative example 1 | 0.225 | 0.33 | A | B | — | Impossible | Impossible |
| Comparative example 2 | 0 | 1.00 | B | D | 1.00 | Possible | Possible |
| Comparative example 3 | 0.225 | 0.37 | B | D | 0.73 | Possible | Possible |

What is claimed is:

1. A method of recycling an image forming material comprising the steps of:

holding a toner image formed by employing toner particles in a toner holding layer formed on an image supporting substrate to faun a first generation image print, separating the toner particles from the first generation image print; and recycling the separated toner particles to form a second generation image print by holding a toner image formed by employing the separated toner particles in a toner holding layer formed on an image supporting substrate, provided that the image forming material comprises at least toner particles, wherein following Conditions (1) and (2) are satisfied, provided that A represents a particle shape factor of the toner particles used for the first generation image print, B represents a particle shape factor of the toner particles after the toner image is held in the toner holding layer of the first generation image print, and C represents a particle shape factor of the toner particles separated from the first generation image print via a separation process, wherein each of the particle shape factors A, B and C is an average value of particle shape factors of 100 toner particles each determined according to a formula of (a minimum diameter of a projection of a particle/a maximum diameter of the projection of the particle):

$$0.9 \geqq B/A \geqq 0.1 \quad \text{Condition (1)}$$

$$1 \geqq C/A \geqq 0.9 \quad \text{Condition (2).}$$

2. The method of recycling the image forming material of claim 1, wherein the toner particles comprise a material exhibiting elasticity or a shape memory effect.

3. The method of recycling the image forming material of claim 1, wherein the image supporting substrate is separated from the first generation image print, and the separated image supporting substrate is used to form the second generation image print.

4. The method of recycling the image forming material of claim 1, wherein the separation process is carried out by immersing the first generation image print in a separation liquid, the separation liquid dissolving or swelling a material constituting the toner holding layer, but not dissolving the toner particles and the image supporting substrate.

5. The method of recycling the image forming material of claim 1, wherein the separation process is carried out by separating the image supporting substrate and the toner holding layer holding the toner image from the first generation image print, followed by immersing the toner holding layer in a separation liquid, the separation liquid dissolving or swelling a material constituting the toner holding layer, but not dissolving the toner particles.

* * * * *